US008659216B2

(12) United States Patent
Below et al.

(10) Patent No.: US 8,659,216 B2
(45) Date of Patent: Feb. 25, 2014

(54) SPARK PLUG ASSEMBLY FOR ENHANCED IGNITABILITY

(71) Applicant: Fram Group IP LLC, Lake Forest, IL (US)

(72) Inventors: Matthew Brian Below, Findlay, OH (US); Steven M. Brickner, Bascom, OH (US); Jerry William Reeves, Jr., Toledo, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/633,315

(22) Filed: Oct. 2, 2012

(65) Prior Publication Data

US 2013/0099652 A1 Apr. 25, 2013

Related U.S. Application Data

(60) Provisional application No. 61/549,481, filed on Oct. 20, 2011.

(51) Int. Cl.
*H01T 13/20* (2006.01)

(52) U.S. Cl.
USPC ..... 313/141; 313/140; 313/118

(58) Field of Classification Search
USPC ..... 313/118, 140, 141
See application file for complete search history.

(56) References Cited

U.S. PATENT DOCUMENTS 4,705,486 A * 11/1987 Myers et al. ..... 445/7
2002/0067111 A1* 6/2002 Shibata et al. ..... 313/141
2005/0264151 A1* 12/2005 Mori et al. ..... 313/141

* cited by examiner

*Primary Examiner* — Mary Ellen Bowman
(74) *Attorney, Agent, or Firm* — Erin J. Fox; Barnes & Thornburg LLP

(57) ABSTRACT

A spark plug is provided having an insulator with a center axis. A center electrode is coupled to the insulator and has a second end extending from an end of the insulator, the center electrode having a first tip member. A ground electrode is spaced apart from the center electrode, wherein the ground electrode has a first portion extending substantially parallel to the center axis and a second portion extending on an angle from the first portion and relative to the center axis. A second tip member is disposed on the second portion of the ground electrode such that the first tip member and the second tip member cooperate to form a gap.

20 Claims, 13 Drawing Sheets

SPARK PLUG ASSEMBLY FOR ENHANCED IGNITABILITY

CROSS REFERENCE TO RELATED APPLICATIONS

This application claims the benefit of U.S. Provisional Patent Application Ser. No. 61/549,481 titled "Spark Plug" and filed Oct. 20, 2011, the contents of which are incorporated herein by reference in their entirety.

BACKGROUND

1. Field of Invention

The subject matter disclosed herein relates to a spark plug for use with an internal combustion engine, and more particularly to a spark plug having a structure providing improved flame kernel development and ignitability.

2. Description of the Background

Conventional spark plugs for use in internal combustion engines generally include a tube-shaped metallic shell, an insulator, a center electrode and a ground electrode. The metal shell has a threaded portion for fitting the spark plug into a combustion chamber for the engine. The insulator has a center bore formed therein and is fixed in the metal shell such that an end of the insulator protrudes from the end of the insulator. The ground electrode has a top portion and is joined to the end of the metal shell such that the tip portion faces the end of the center electrode across a gap.

The gap between the center electrode and the tip portion is generally perpendicular to the axis of the spark plug. Similarly, if the tip portions of the center electrode and ground electrode are collinear, a gap axis defined by the center electrode and ground electrode is generally perpendicular to the axis of the spark plug. As a result, the direction of the burn front is limited at least initially in a sideways direction relative to the spark plug axis. The burn front must travel around the ground electrode structure which slows the speed of the burn front. Further, this movement also draws thermal energy from the burn front that could be used to keep the burn front ignited and expanding.

Accordingly, while existing spark plugs are suitable for their intended purposes the need for improvement remains, particularly in providing a spark plug with an electrode structure that facilitates propagation of the burn front.

SUMMARY

According to one aspect of the invention, a spark plug is provided. The spark plug includes an insulator having a center axis. A center electrode is coupled to the insulator and has a second end extending from an end of the insulator, the center electrode having a first tip member. A ground electrode is spaced apart from the center electrode, the ground electrode having a first portion extending substantially parallel to the center axis and a second portion extending at an angle from the first portion and relative to the center axis. A second tip member is disposed on the second portion of the ground electrode, wherein the first tip member and the second tip member cooperate to form a gap.

According to another aspect of the invention, a spark plug is provided, the spark plug including a metal shell having a bore extending axially therethrough. An insulator is at least partially disposed in the metal shell, the insulator having a center axis. A center electrode having a first tip member that extends from an end of the insulator. A ground electrode is coupled to the metal shell, the ground electrode having a first portion extending substantially parallel to the center axis and a second portion coupled of the first portion and extending at an angle from the first portion and relative to the center axis. A second tip member is disposed on the second portion of the ground electrode, wherein the first tip member and the second tip member cooperate to form a gap.

According to another aspect of the invention, a spark plug is provided. The spark plug includes a metal shell having a bore extending axially therethrough. An insulator is at least partially disposed in the metal shell, the insulator having a center axis. A center electrode is coupled to the insulator has a first tip member that extends past a first end of the insulator. A ground electrode is coupled to the metal shell, the ground electrode having a first portion extending substantially parallel to the center axis, a connection portion extending at an angle from the first portion and relative to the center axis, and a second portion extending from the connection portion, the second portion extending substantially parallel to the center axis but not collinear with the first portion. A second tip member is disposed on the second portion of the ground electrode, wherein the first tip member and the second tip member cooperate to form a gap.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains the embodiments of the invention, together with advantages and features, by way of example with reference to the drawings.

DETAILED DESCRIPTION

Conventional spark plugs include a gap between the center electrode and the ground electrode. This gap is generally perpendicular to the longitudinal axis of the spark plug. As a result, the burn front of the flame ignited by the spark plug must travel around the ground electrode strap before burning a fuel mixture in the combustion chamber of an internal combustion engine. Embodiments of the present invention provide advantages in arranging an electrode structure that reduces the impingement of the ground strap on the burn front to allow the flame to more freely propagate the flame into the combustion chamber.

Figure 1:
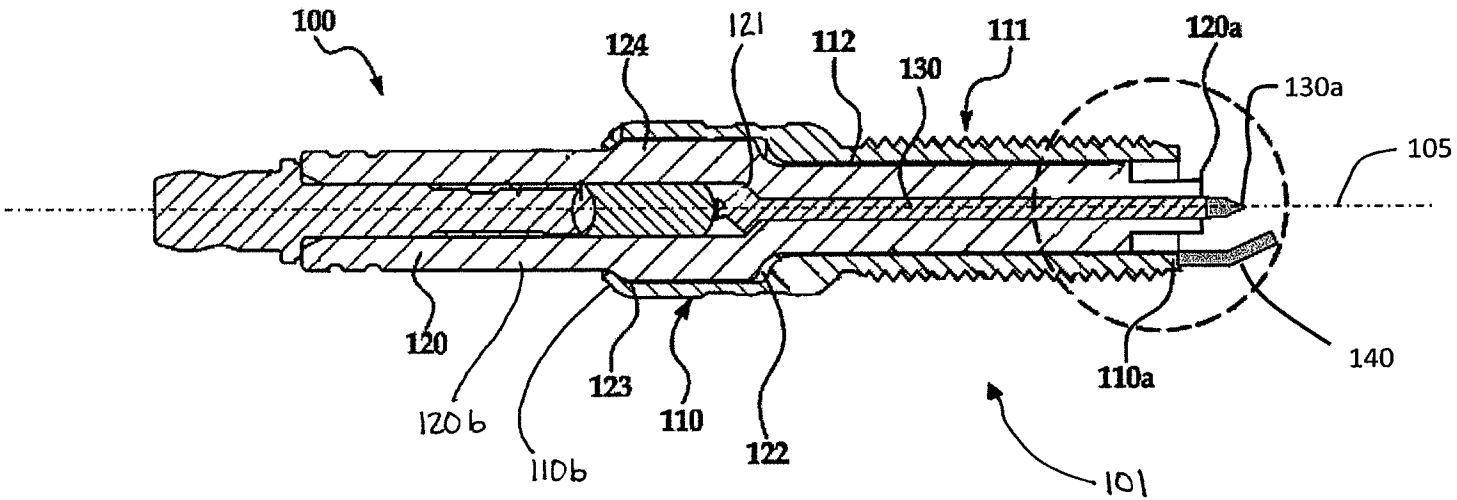
FIG. 1 is a side sectional view of a spark plug in accordance with an embodiment of the invention.
Figure 2:
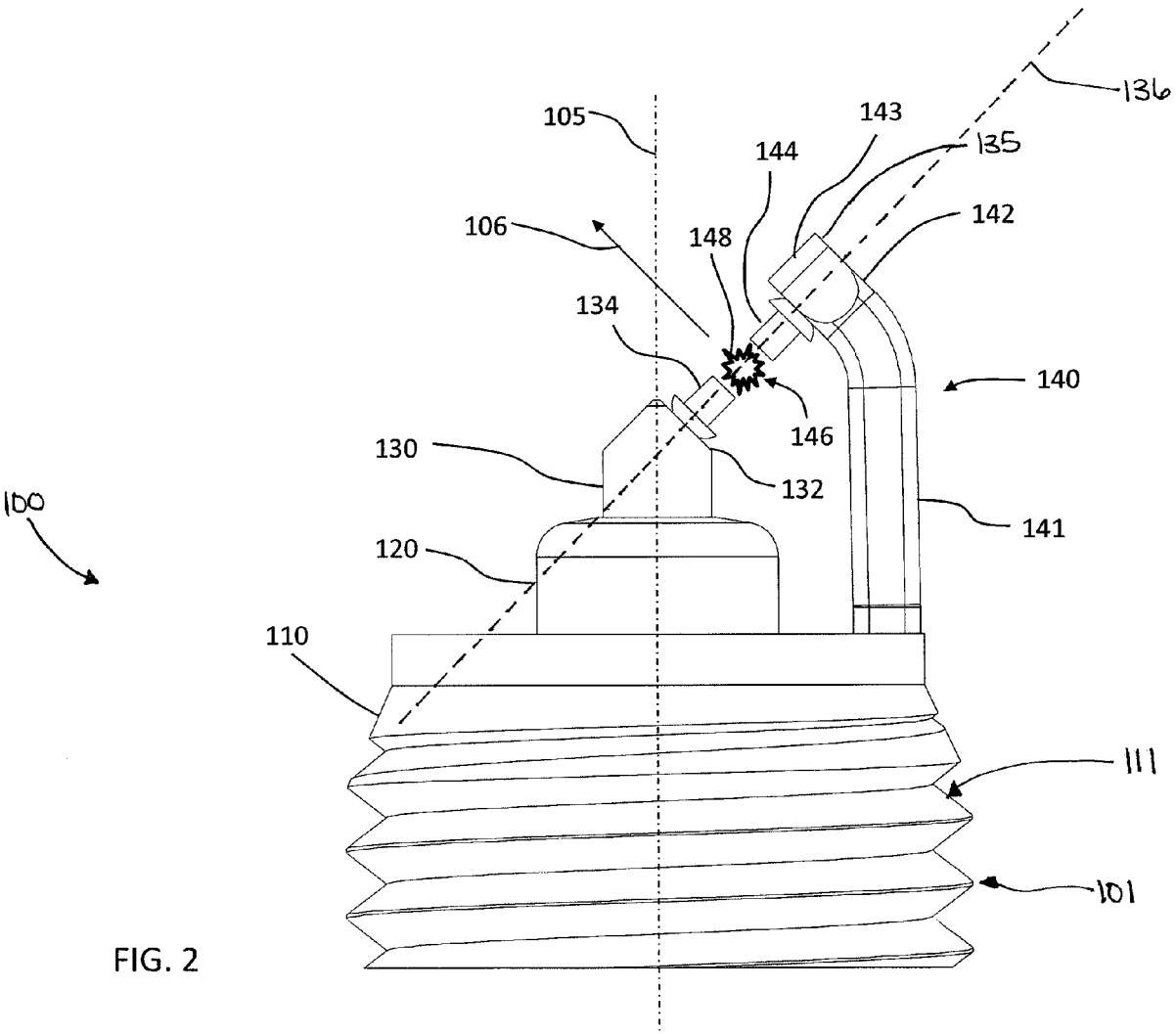
FIG. 2 is a side view of the electrode end of the spark plug of FIG. 1 in accordance with the exemplary embodiment of the invention.
Figure 3:
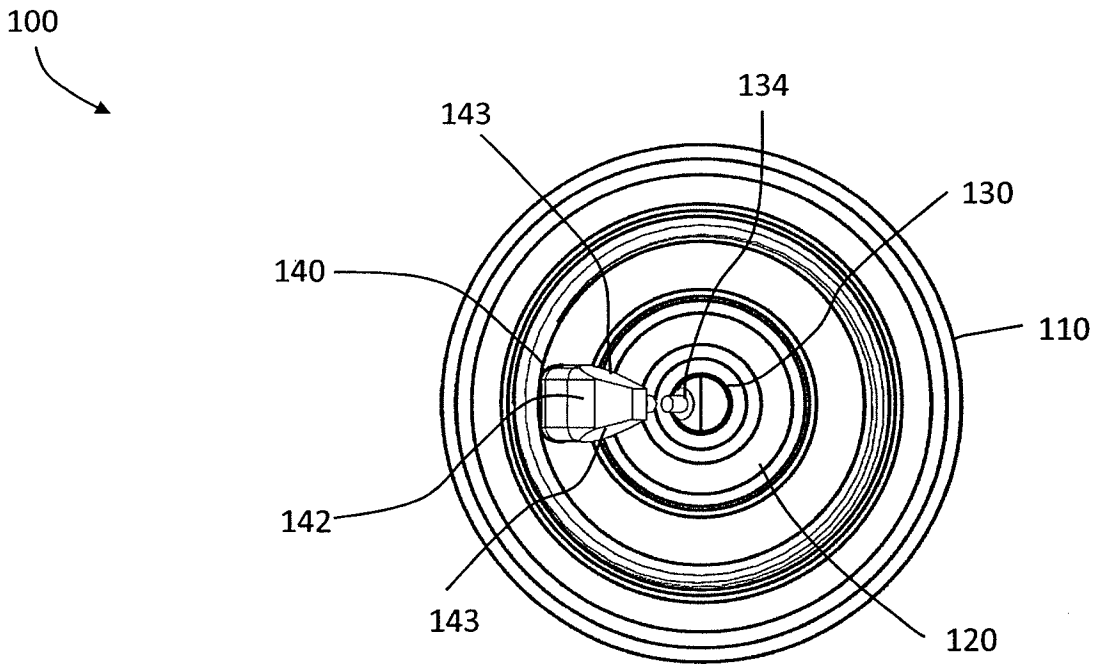
FIG. 3 is a top view of the spark plug of FIG. 1 in accordance with an embodiment of the invention; and, FIGS. 4-21 are views of alternative embodiments of the electrode end of the spark plug of FIG. 1.

An exemplary spark plug 100 is shown in FIGS. 1-3 having an electrode structure configured on an angle to direct the burn front of a flame into a combustion chamber (not shown). The spark plug 100 is designed for use in internal combustion engine of automobile vehicles. The installation of the spark plug 100 into an internal combustion engine is achieved by fitting a combustion-chamber side 101 of the spark plug 100 so that it protrudes into a combustion chamber through a threaded bore provided in the engine head (not shown).

The spark plug 100 includes a tube-shaped metal shell 110, an insulator 120, a center electrode 130 and a ground electrode 140. The ground electrode 140 is coupled to the metal shell 110 on the combustion-chamber side 101 of the spark plug 100.

The metal shell 110 is made from a conductive metal material such as steel for example. The metal shell 110 has a threaded shank portion 111 on the outer periphery on the combustion-chamber side 101, as illustrated in FIG. 1. The threaded shank portion 111 cooperates with a thread in the engine head to couple the spark plug 100 to the engine. The metal shell 110 also includes an axial bore 112 that extends along its length.

The insulator 120 is an elongated component that is at least partially disposed within the axial bore 112, as illustrated in FIG. 1. The insulator 120 may be made from a nonconducting ceramic material such as, but not limited to, alumina ceramic for example. This arrangement allows the center electrode 130 to be retained within the insulator 120 while preventing an electrical conductive path from forming between the center electrode 130 and the metal shell 110. The insulator 120 is coupled to the metal shell 110 such that a first end 120*a* of the insulator 120 protrudes from an end 110*a* of the metal shell 110. Opposite to the first end 120*a*, the insulator has a second end 120*b* that protrudes from an opposite end 110*b* of the metal shell 110. Insulator 120 includes an axial bore 121 that extends through the insulator 120 and is sized to fit the center electrode 130. The insulator 120 may also include exterior shoulders 122, 123 arranged at either end of an expanded flange portion 124, as illustrated in FIG. 1.

The center electrode 130 is made from an electrically conductive and highly heat conductive metal material, such as but not limited to copper for example, as a core material. The core material may have cladding that is made from a heat resistant, corrosion-resistant metal material, such as, but not limited to, a solid nickel alloy or Inconel for example. The center electrode 130 may also be made from a nickel based alloy without having a separate core and cladding component. Center electrode 130 is secured in the axial bore 112 such that it is electrically isolated from the metal shell 110. Center electrode 130, insulator 120, and metal shell 110 are arranged to lie along a center axis 105 of the spark plug 100.

In the exemplary embodiment, the center electrode 130 has a first end 130*a* that is arranged to protrude beyond the first end 120*a* of insulator 120. In the exemplary embodiment, the center electrode 130 includes a conical end 132 having a 45 degree angle from the center axis 105 of the spark plug 100, as illustrated in FIG. 2. A tip member 134 is coupled to conical end 132. The tip member 134 may be coupled by any suitable means, such as welding for example. In the exemplary embodiment, the tip member 134 is welded to conical end 132 after the center electrode 130 is assembled into the insulator 120.

The ground electrode 140 is coupled to the metal shell 110 on the end 110*a* of metal shell 110. The ground electrode 140 may be made from an electrically conductive metal material, such as, but not limited to, a nickel-based material for example. In the exemplary embodiment and as illustrated in FIG. 2, the ground electrode 140 is a J-shaped member having a first portion 141 that extends from the metal shell 110 and a second portion 142 that is arranged at an angle relative to the center axis 105. An end 135 of the second portion 142 may include at least one chamfered surface 143. As will be discussed in more detail below, the chamfered surface 143 assists in reducing the profile of the ground electrode 140, which reduces the flame impingement on the second portion 142 of the ground electrode 140. In the exemplary embodiment, the second portion 142 is at a 45 degree angle relative to the center axis 105. The ground electrode 140 includes a tip member 144 on a side, such as the chamfered surface 143, facing the tip member 134 of the center electrode 130, as illustrated in FIG. 2. The tip member 144 may be coupled to the ground electrode by any suitable method, such as welding for example. In one embodiment, the tip member 144 is welded to ground electrode 140 near the chamfered surface 143 after the ground electrode 140 is welded to the metal shell 110. The tip members 134, 144 cooperate to form a gap 146 across which an arc 148 forms during operation. In the exemplary embodiment, when tip members 134, 144 are collinear, tip members 134, 144 are arranged to define a gap axis 136, as illustrated in FIG. 2.

It should be appreciated that the arrangement of the gap 146 at an angle of less than 90 degrees with respect to the center axis 105, such that the second portion 142 is not perpendicular to the center axis 105 and the gap axis 136 is not parallel to the center axis 105, provides advantages in reducing the impingement of the ground electrode 140 on the burn front. As shown in FIG. 2, the burn front is directed toward the combustion chamber as indicated by directional arrow 106. This provides an increased speed of flame kernel development. This arrangement provides further advantages in reducing the height of the ground electrode 140 to reduce the surface area to further reduce the amount of flame impingement. This arrangement provides still further advantages in that the reduced height of the ground electrode 140 allows for the tip members 134, 144 to be welded after assembly of the spark plug 100 onto the center electrode 130 and ground electrode 140, respectively.

It should further be appreciated that since a more efficient burn front is created by the spark plug 100, a smaller diameter center electrode 130 may be used. This allows for a larger cross-sectional thickness of the insulator 120 which provides advantages in improving the thermal insulation of the center electrode 130 from the engine temperatures. Alternatively, the smaller diameter center electrode 130 may allow for a smaller overall diameter spark plug 100.

Figure 14:
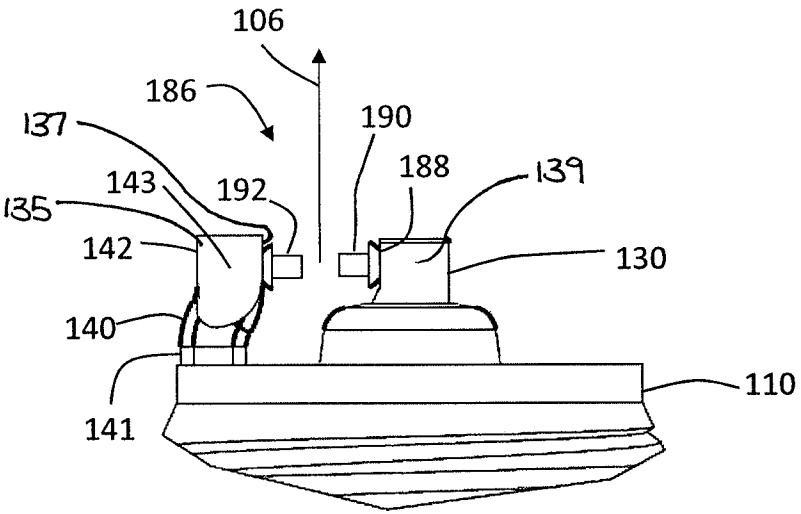

It should still further be appreciated that while embodiments herein describe the gap 146, or the gap axis 136 when tip members 134, 144 are collinear, as having a 45 degree angle relative to the center axis 105, as illustrated in FIG. 2, this is for exemplary purposes only and the claimed invention should not be so limited. The gap 146, or gap axis 136, may be on any angle between 0 and 90 degrees from the center axis 105. Similarly, second portion 142 may be on any angle between 0 degrees and 90 degrees which allows the tip member 144 to be disposed adjacent the tip member 134 such that the ground electrode 140 is positioned between the center electrode 130 and the combustion chamber. As will be discussed in more detail below, for example, the second portion 142 may arrange the tip member 144 to be perpendicular to the center axis 105 while also being offset from the center axis 105, as illustrated in FIG. 14. In still other embodiments, the second portion 142 may be arranged on a 30 degree angle or a 60 degree angle from the center axis 105, for example.

Figure 5:
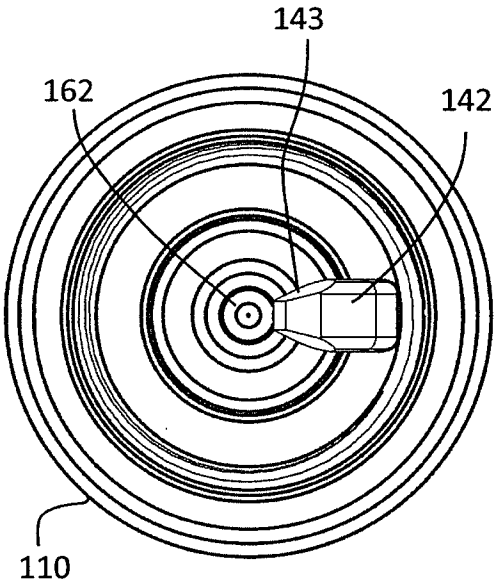
Figure 4:
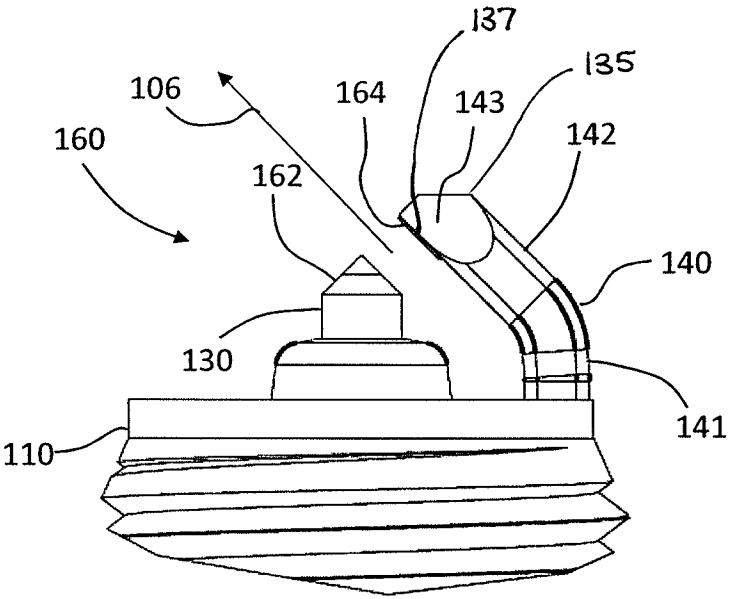

Referring now to FIGS. 4-5, another embodiment of the spark plug 100 is shown having an electrode end 160. In this embodiment, the center electrode 130 has a conical tip member 162 formed on the end. Similar to the embodiment described above, the ground electrode 140 has a first portion 141 and a second portion 142 that extends on an angle from the first portion 141. The end 135 of the ground electrode 140 includes chamfered surfaces 143 to reduce the profile of the ground electrode 140 to the burn front. In this embodiment, the second portion 142 includes a tip member 164 that is a thin planar member coupled to an inward-facing surface 137 of the second portion 142, the inward-facing surface 137 being adjacent to the center electrode 130. In this embodiment, the burn front can travel in the direction of directional arrow 106 that is approximately 45 degress from the center axis 105, avoiding impingment on the ground electrode 140.

Figure 7:
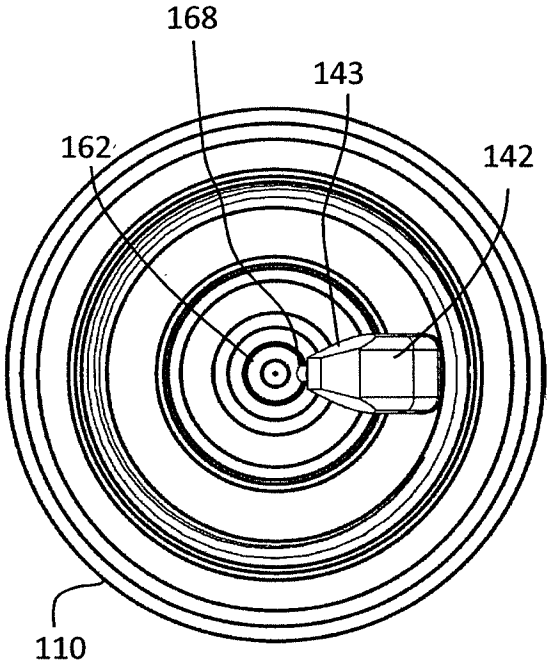
Figure 6:
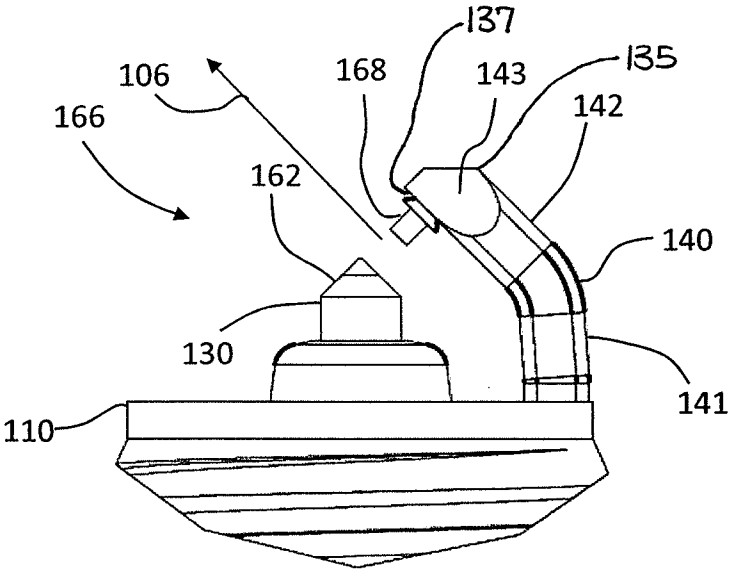

Referring to FIGS. 6-7, another embodiment of spark plug 100 is shown having an electrode end 166. In this embodiment, the center electrode 130 has the conical tip member 162 formed on the electrode end 166. Similar to the embodiments described above, the ground electrode 140 has the first portion 141 and the second portion 142 that extends on an angle from the first portion 141. The end 135 of the ground electrode 140 includes chamfered surfaces 143 to reduce the profile of the ground electrode 140 to the burn front. In this embodiment, a tip member 168 is a rivet-type tip member coupled, such as by welding for example, to the inward-facing surface 137 of the second portion 142 adjacent the center electrode 130. In this embodiment, the burn front can travel in the direction of directional arrow 106 that is approximately 45 degress from the center axis 105, avoiding impingment on the ground electrode 140.

Figure 9:
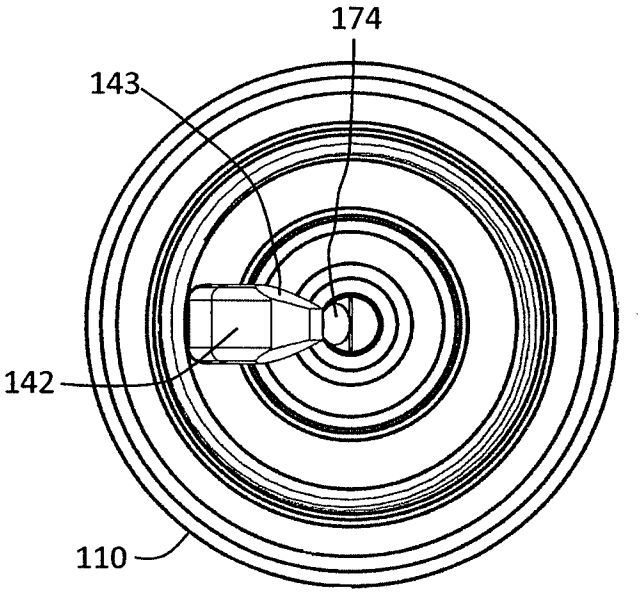
Figure 8:
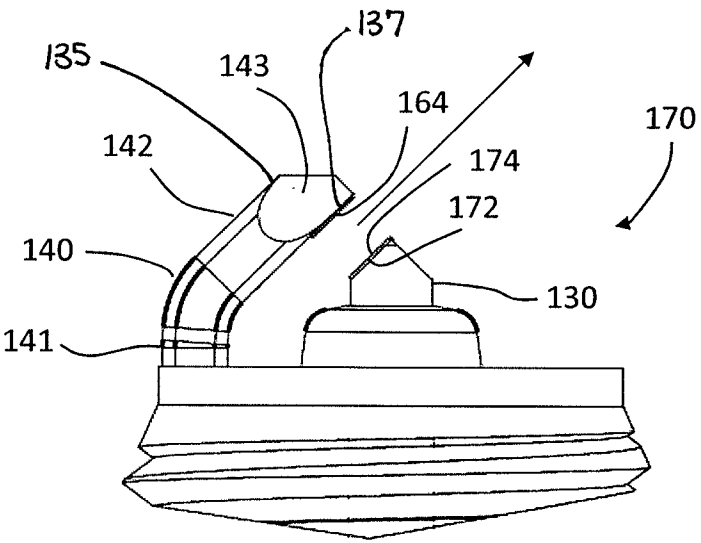

Referring to FIGS. 8-9, another embodiment of spark plug 100 is shown having an electrode end 170 with the center electrode 130 having an angled surface 172. Coupled to the angled surface 172 is a tip member 174. In this embodiment, the tip member 174 is a thin planar circular member. Similar to the embodiments described above, the ground electrode 140 has the first portion 141 and the second portion 142 that extends on an angle from the first portion 141. The end 135 of the ground electrode 140 includes chamfered surfaces 143 to reduce the profile of the ground electrode 140 to the burn front. In this embodiment, the thin planar tip member 164 is coupled to the inward-facing surface 137 of the second portion 142 adjacent the center electrode 130. In this embodiment, the burn front can travel in the direction of directional arrow 106 that is approximately 45 degress from the center axis 105, avoiding impingment on the ground electrode 140.

Figure 11:
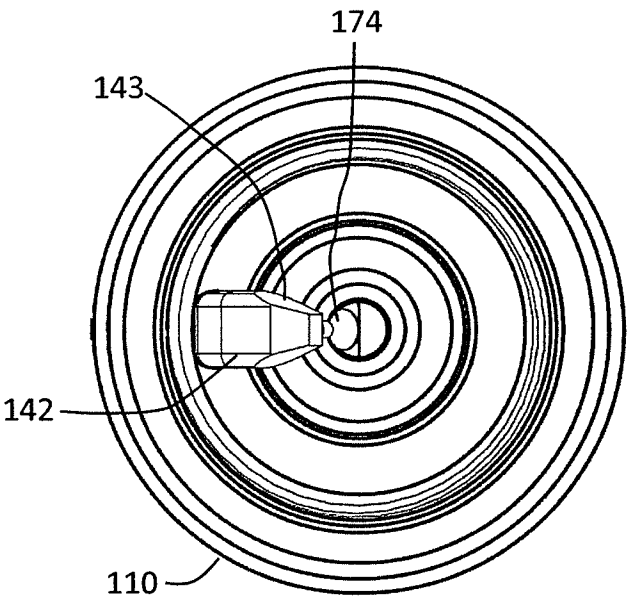
Figure 10:
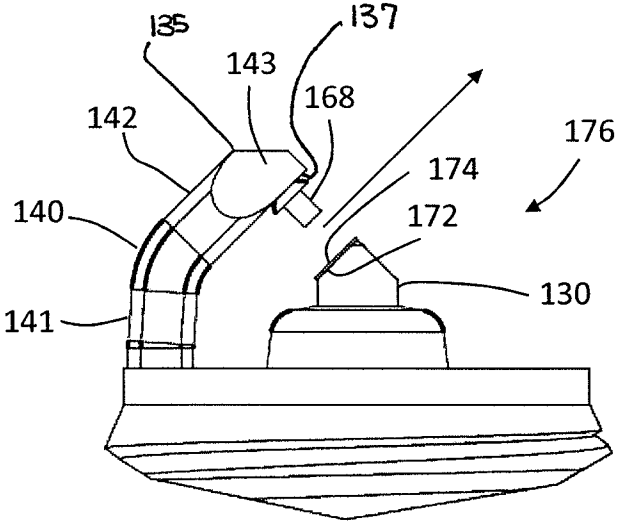

Referring to FIGS. 10-11, another embodiment of spark plug 100 is shown having an electrode end 176 with the center electrode 130 having the angled surface 172. Coupled to the angled surface 172 is the tip member 174. In this embodiment, the tip member 174 is a thin planar circular member and may be coupled to the angled surface by any means known such as, but not limited to, a welding process. Similar to the embodiments described above, the ground electrode 140 has the first portion 141 and the second portion 142 that extends on an angle from the first portion 141. The end 135 of the ground electrode 140 includes chamfered surfaces 143 to reduce the profile of the ground electrode 140 to the burn front. In this embodiment, the tip member 168 is a rivet-type tip coupled to the inward-facing surface 137 of the second portion 142 adjacent the center electrode 130. In this embodiment, the burn front can travel in the direction of directional arrow 106 that is approximately 45 degress from the center axis 105, avoiding impingment on the ground electrode 140.

Figure 13:
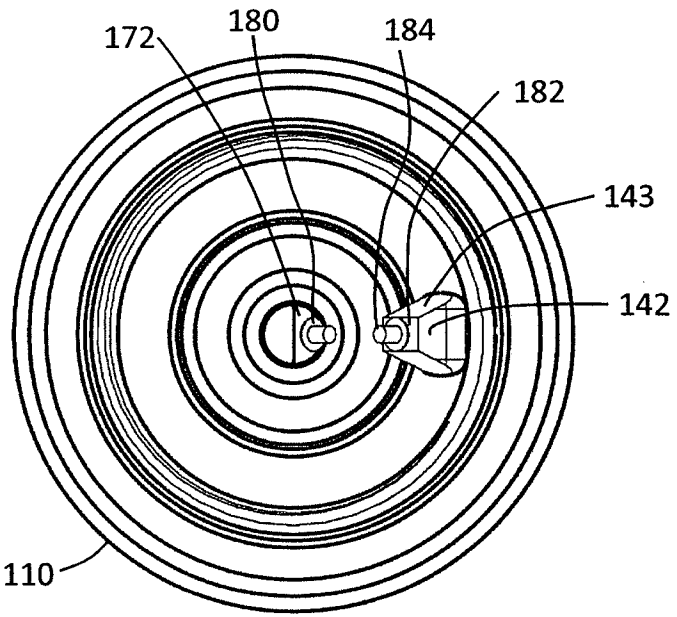
Figure 12:
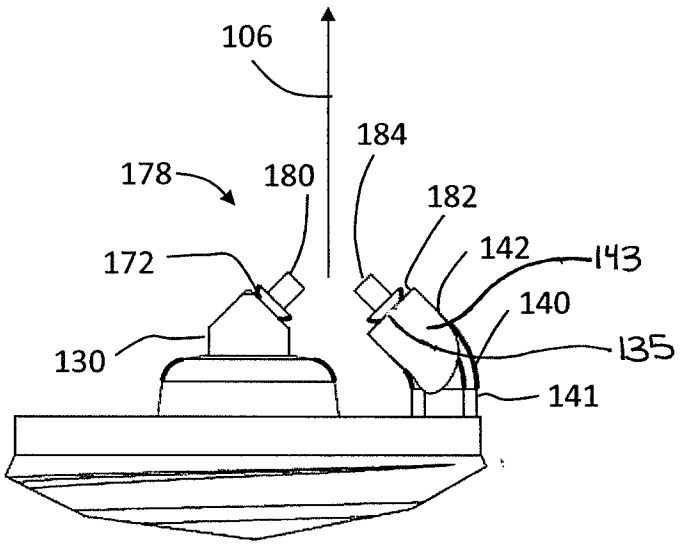

Referring to FIGS. 12-13, another embodiment of spark plug 100 is shown having an electrode end 178. In this embodiment, the center electrode 130 has the angled surface 172 with a rivet-type tip member 180 coupled thereon. The ground electrode 140 has the first portion 141 and the second portion 142 extending on an angle therefrom. The second portion 142 further includes chamfered surfaces 143 to reduce the profile of the end of the ground electrode 140. The chamfered surface 143 which extend to a planar surface 182 on the end 135 of the ground electrode 140. Coupled to the planar surface 182 is a rivet-type tip member 184. In this embodiment, the tip members 180, 184 are arranged on opposing 45 degree angles relative to the center axis such that the included angle between the tip members 180, 184 is 90 degrees. In this embodiment, the burn front can travel in the direction of directional arrow 106 that is aligned to be approximately parallel with the center axis 105, while avoiding impingment on the ground electrode 140.

Figure 15:
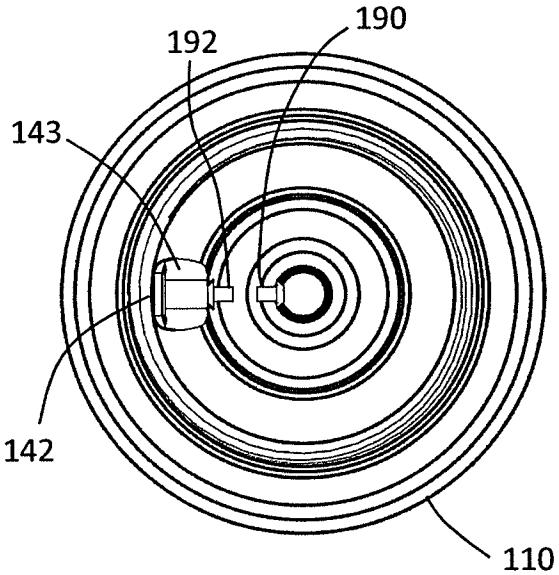

Referring to FIGS. 14-15, another embodiment of spark plug 100 is shown having an electrode end 186. In this embodiment, the center electrode 130 is substantially cylindrical with a planar surface 188 formed on an annular side wall 139. Coupled to the planar surface 188 is a rivet-type tip member 190. The tip member 190 is arranged substantially perpendicular to the center axis. The ground electrode 140 is coupled to the metal shell 110 on a side adjacent the tip member 190. The ground electrode 140 has the first portion 141 and the second portion 142 extending in a non-linear manner therefrom, as illustrated in FIG. 14. The second portion 142 is generally parallel to and offset from the first portion 141. Ground electrode 140 includes chamfered surfaces 143 to reduce the profile of the end 135 of the ground electrode 140. Coupled to the inward-facing surface 137 of the second portion 142 is a rivet-type tip member 192. The tip member 192 is disposed opposite the tip member 190 and is substantially perpendicular to the center axis 105. In this embodiment, the burn front can travel in the direction of directional arrow 106 that is approximately parallel to the center axis 105 without impinging on the ground electrode 140.

Figure 16:
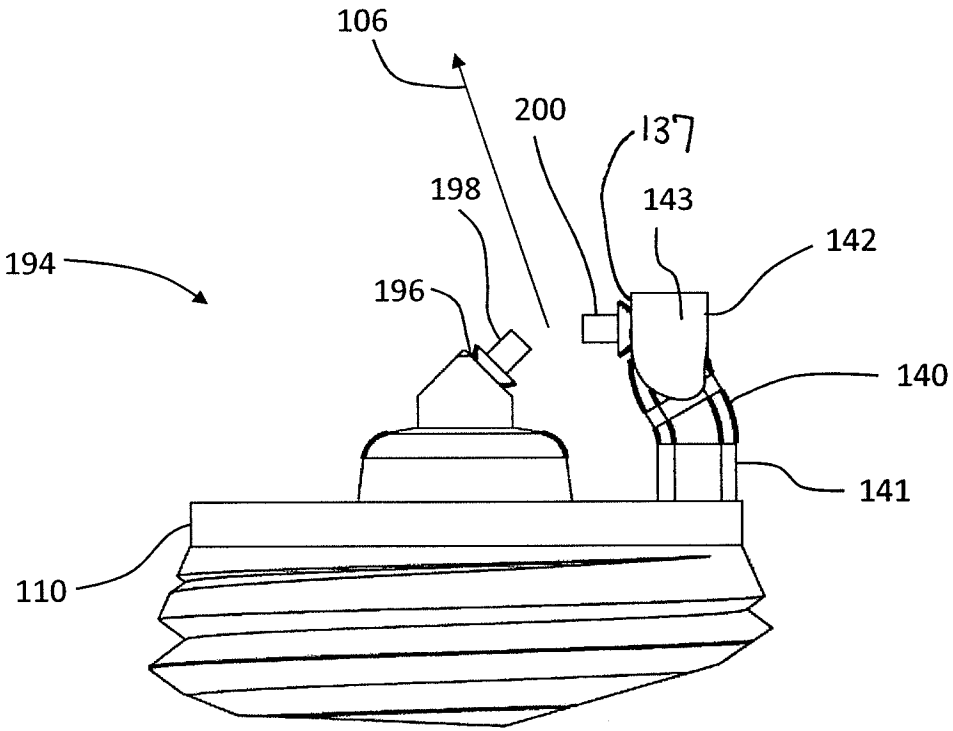

Referring to FIG. 16, another embodiment of spark plug 100 is shown having an electrode end 194. In this embodiment, the center electrode 130 has an angled surface 196 with a rivet-type tip member 198 coupled thereto. Coupled to the metal shell 110 adjacent the tip member 198 is the ground electrode 140. The ground electrode 140 includes the first portion 141 and the second portion 142 extending in a non-linear manner therefrom, as illustrated in FIG. 16. The second portion 142 is generally parallel to and offset from the first portion 141. The second portion 142 has a pair of chamfered surfaces 143 that reduce the profile of the ground electrode 140. Coupled to the inward-facing surface 137 of the second portion 142 of the ground electrode 140 adjacent the tip member 198 is a rivet-type tip member 200. The tip member 200 is disposed opposite the tip member 198. The tip member 200 is generally perpendicular to the center axis 105. In this embodiment, the bum front can travel in the direction of directional arrow 106 that is between 0 and 45 degress from the center axis 105, avoiding impingment on the ground electrode 140.

Figure 17:
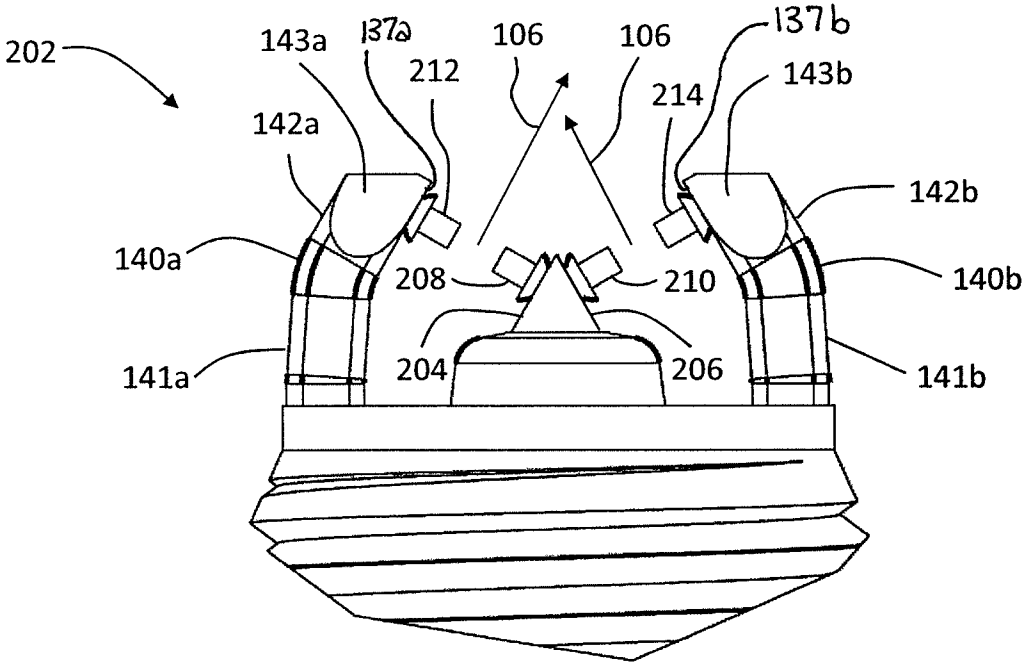

Referring to FIG. 17, another embodiment of spark plug 100 is shown having an electrode end 202. In this embodiment, the center electrode 130 has two angled surfaces 204, 206, each having a rivet-type tip member 208, 210 respectively coupled to the angled surfaces 204, 206. A first ground electrode **140*a* is coupled to the metal shell 110 adjacent the first tip member 208 and a second ground electrode 140*b* is coupled to the metal shell 110 adjacent the second tip member 210. The ground electrodes 140*a*, 140*b* each include a first portion 141*a*, 141*b* and a second portion 142*a*, 142*b*, respectively. Each ground electrode 140*a*, 140*b* further has a pair of chamfered surfaces 143*a*, 143*b* to reduce the profile of the ground electrodes to the burn front. Coupled to an angled inwardly-facing surface 137*a*, 137*b* on the second portion 142*a*, 142*b* of each ground electrode 140*a*, 140*b* is a rivet-type tip member 212, 214. Tip members 212, 214 are disposed opposite of tip members 208, 210, respectively. In this embodiment, the burn front can travel in the direction of directional arrows 106***a*, 106*b* without impinging on the ground electrodes 140*a*, 140*b*.

Figure 19:
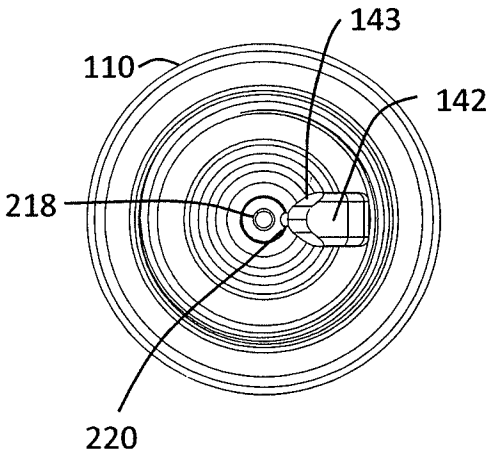
Figure 18:
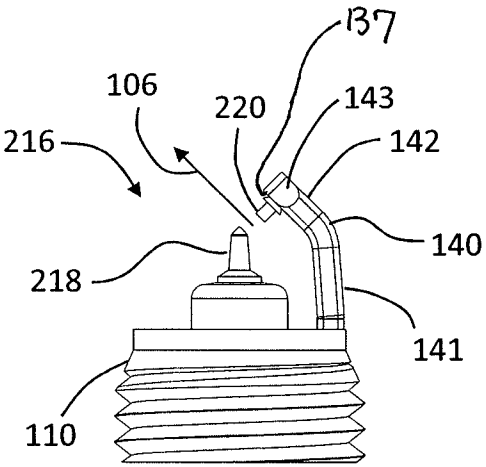

Referring to FIGS. 18-19, another embodiment of spark plug 100 is shown having an electrode end 216. In this embodiment, the center electrode 130 includes a fine wire type of tip member 218 that projects from the center electrode 130 substantially along the center axis 105. Coupled to the metal shell 110 adjacent the center electrode 130 is the ground electrode 140. Ground electrode 140 includes the first portion 141 and the second portion 142 that extends on an angle from the first portion 141. The second portion 142 has at least one chamfered surface 143 that reduces the profile of the ground electrode 140. A rivet-type tip member 220 is coupled to the inward-facing surface 137 of the second portion 142 adjacent the tip member 218. In this embodiment, the burn front can travel in the direction of directional arrow 106 that is approximately 45 degress from the center axis 105, avoiding impingment on the ground electrode 140.

Figure 21:
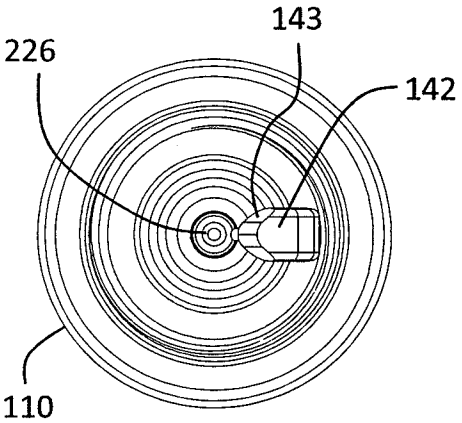
Figure 20:
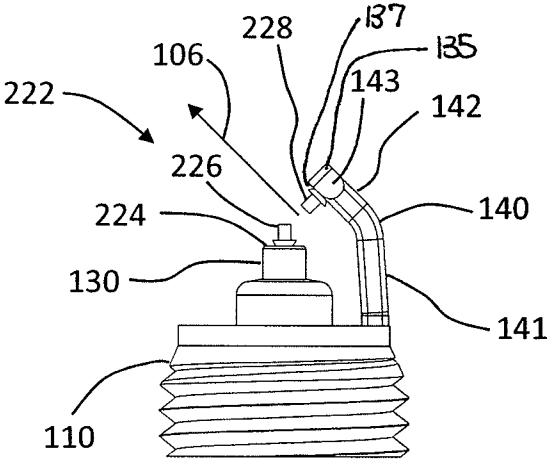

Referring to FIGS. 20-21, another embodiment of spark plug 100 is shown having an electrode end 222. In this embodiment, the center electrode 130 includes an end surface 224, the end surface 224 being substantially perpendicular to the center axis 105. Coupled to the end surface 224 is a rivet-type tip member 226. Coupled to the metal shell 110 is a ground electrode 140. The ground electrode 140 includes the first portion 141 and the second portion 142 that extends on an angle from the first portion 141. A pair of chamfered surfaces 143 are arranged on the end 135 of the second portion 142 to reduce the profile of the ground electrode 140 to the burn front. A rivet-type tip member 228 is coupled to an inward-facing surface 137 of the second portion 142 of the ground electrode 140 adjacent the tip member 226. In this embodiment, the burn front can travel in the direction of directional arrow 106 that is approximately 45 degress from the center axis 105, avoiding impingment on the ground electrode 140.

While the tip members herein are shown and described as being a rivet-type tip member, a conical tip member, or a thin planar member, the tip members may be of any suitable shape, for example, cylindrical.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A spark plug comprising:

an insulator having a center axis;

a center electrode coupled to the insulator and having a second end extending from an end of the insulator, the center electrode having a first tip member;

a ground electrode spaced from the center electrode, the ground electrode having a first portion extending substantially parallel to the center axis and a second portion coupled to the first portion and extending at an angle from the first portion and relative to the center axis; and, a second tip member disposed on the second portion of the ground electrode, wherein the first tip member and the second tip member cooperate to form a gap;

wherein the first tip member is conical in shape and includes a surface that forms a spark with the second tip member and in the gap.

2. The spark plug of claim 1, wherein the first tip member and the second tip member are substantially collinear to define a gap axis.

3. The spark plug of claim 2, wherein the gap axis is disposed at an angle with respect to the center axis, wherein the angle is greater than 0 degrees and less than 90 degrees.

4. The spark plug of claim 3, wherein the gap axis is at a 45 degree angle from the center axis.

5. The spark plug of claim 1, wherein the first tip member includes a member attached to the surface of the conical tip member, wherein the member is selected from the group consisting of a rivet member, a cylindrical member, or a thin planar member.

6. The spark plug of claim 5, wherein the first tip member is welded onto the center electrode.

7. The spark plug of claim 5, wherein the second tip member is selected from the group consisting of a rivet-type tip member, a conical tip member, or a thin planar member.

8. The spark plug of claim 7, wherein the second tip member is welded onto the second portion of the ground electrode.

9. The spark plug of claim 1, wherein the first tip member is coupled to a chamfered surface of the center electrode.

10. The spark plug of claim 1, wherein the second tip member is coupled to a chamfered surface of the second portion of the ground electrode.

11. The spark plug of claim 1, wherein the spark plug includes a second ground electrode spaced from the center electrode, the second ground electrode having a first portion extending substantially parallel to the center axis and a second portion coupled to the first portion and extending on an angle from the first portion relative to the center axis.

12. The spark plug of claim 11, wherein the center electrode has two angled surfaces, the first tip member disposed on one angled surface and a third tip member disposed on the other angled surface.

13. The spark plug of claim 12, wherein a fourth tip member is disposed on the second portion of the second ground electrode adjacent the third tip member, wherein the third tip member and the fourth tip member cooperate to form a second gap.

14. The spark plug of claim 11, wherein the ground electrode and the center electrode define a first gap axis and the second ground electrode and the center electrode define a second gap axis, wherein the first gap axis and the second gap axis are disposed at a first and second angles with respect to the center axis and the first and second angles are greater than 0 degrees and less than 90 degrees.

15. The spark plug of claim 1, wherein the first tip member is angled 45 degrees relative to the second tip member.

16. The spark plug of claim 1, wherein the first tip member is angled 135 degrees relative to the second tip member.

17. A spark plug comprising:

a metal shell having a bore extending axially therethrough;

an insulator at least partially disposed in the metal shell, the insulator having a center axis;

a center electrode coupled to the insulator and having a first tip member that extends past an end of the insulator;

a ground electrode coupled to the metal shell, the ground electrode having a first portion extending substantially parallel to the center axis, a second portion extending at an angle from the first portion relative to the center axis, and a third portion extending from the second portion, the third portion extending substantially parallel to the center axis but not collinear with the first portion; and a second tip member disposed on the third portion of the ground electrode, wherein the first tip member and the second tip member cooperate to form a gap.

18. The spark plug of claim 17, wherein the first tip member and the second tip member are substantially collinear to define a gap axis that is not parallel to the center axis.

19. The spark plug of claim 18, wherein the gap axis is perpendicular to the center axis.

20. The spark plug of claim 17, wherein the first tip member and the second tip member are arranged on opposing 45 degree angles relative to the center axis.

* * * * *